US011957240B2

(12) United States Patent
Melville et al.

(10) Patent No.: US 11,957,240 B2
(45) Date of Patent: Apr. 16, 2024

(54) PORTABLE MODULAR HEIGHT-ADJUSTABLE TABLE

(71) Applicants: Mark Kenneth Melville, Saint Louis, MO (US); Jeffrey Frank Fiala, Saint Louis, MO (US)

(72) Inventors: Mark Kenneth Melville, Saint Louis, MO (US); Jeffrey Frank Fiala, Saint Louis, MO (US)

( * ) Notice: Subject to any disclaimer, the term of this patent is extended or adjusted under 35 U.S.C. 154(b) by 0 days.

(21) Appl. No.: 17/453,393

(22) Filed: Nov. 3, 2021

(65) Prior Publication Data

US 2022/0133031 A1 May 5, 2022

Related U.S. Application Data

(60) Provisional application No. 63/198,677, filed on Nov. 3, 2020.

(51) Int. Cl.
*A47B 13/16* (2006.01)
*A47B 5/02* (2006.01)
*A47B 37/04* (2006.01)

(52) U.S. Cl.
CPC ..... *A47B 13/16* (2013.01); *A47B 5/02* (2013.01); *A47B 37/04* (2013.01)

(58) Field of Classification Search
CPC ..... A47B 13/16; A47B 5/02; A47B 37/04; A47B 13/081; A47B 13/023; A47B 13/10; A47B 3/06; A47B 2013/024
USPC ..... 108/25, 26, 42, 43, 47, 48, 65, 69, 78, 108/102, 103, 105; 248/146
See application file for complete search history.

(56) References Cited

U.S. PATENT DOCUMENTS 2,601,177 A * 6/1952 Smullen ..... B60N 3/004 297/135
2,986,438 A 5/1961 Smathers et al.
3,143,980 A * 8/1964 Sperring ..... A47B 96/066 108/182
3,624,732 A 11/1971 Bowden
4,441,433 A * 4/1984 Caldwell ..... A47B 57/52 248/222.51
4,524,701 A 6/1985 Chappell
4,893,363 A * 1/1990 Huff ..... E04H 4/144 4/496
5,170,720 A 12/1992 Scheurer
5,197,394 A 3/1993 Schmidt
5,647,075 A 7/1997 Perkins
5,893,331 A * 4/1999 Diletto ..... A47C 7/70 297/135
6,439,133 B1 8/2002 Jaramillo
6,637,350 B2 10/2003 McKsymick
6,705,240 B2 3/2004 Block et al.

(Continued)

FOREIGN PATENT DOCUMENTS

CA 2786190 * 2/2014
CN 110141044 * 8/2019

*Primary Examiner* — Janet M Wilkens

(57) ABSTRACT

A portable, modular tabletop and tabletop system are herein disclosed. The tabletop includes a pair of side panels movably coupled thereto for holding beverages. The tabletop can selectively couple to support rods, that hook onto a variety of surfaces, or a table stem and base that enable the tabletop system to be a free-standing structure. The table stem is adjustable height. The base is designed in such a way that it can stably support the tabletop on a variety of surface types.

4 Claims, 5 Drawing Sheets

(56) References Cited

U.S. PATENT DOCUMENTS

| | | | | |
|---|---|---|---|---|
| 6,945,502 | B2 | 9/2005 | Restifo | |
| 6,997,111 | B2 | 2/2006 | Giegerich | |
| 7,448,688 | B2 * | 11/2008 | Farah | A47C 16/02 297/217.7 |
| 7,641,156 | B2 | 1/2010 | Medders et al. | |
| 8,245,650 | B1 | 8/2012 | McKsymick | |
| 8,347,790 | B1 | 1/2013 | Maiers | |
| 8,573,138 | B2 | 11/2013 | Unger | |
| 9,392,868 | B2 | 7/2016 | Nardi | |
| 9,655,437 | B2 | 5/2017 | Clause et al. | |
| 9,743,754 | B2 | 8/2017 | Ergun et al. | |
| 9,795,234 | B2 | 10/2017 | Higgins | |
| 10,130,166 | B1 * | 11/2018 | Prokopovich | B65D 33/14 |
| 11,311,103 | B1 * | 4/2022 | Wilson | A47B 9/00 |
| 2002/0043181 | A1 | 4/2002 | Gist | |
| 2003/0000429 | A1 * | 1/2003 | Ryburg | A47B 23/04 108/42 |
| 2003/0079661 | A1 | 5/2003 | Luu | |
| 2008/0224505 | A1 | 9/2008 | Gerard | |
| 2011/0209645 | A1 | 9/2011 | Albornoz Pinzon et al. | |
| 2013/0025506 | A1 * | 1/2013 | Brennan | A47B 21/0314 108/103 |
| 2013/0068142 | A1 * | 3/2013 | Wellman | A47B 37/04 108/42 |
| 2013/0098275 | A1 | 4/2013 | Blekestad et al. | |
| 2014/0102337 | A1 * | 4/2014 | Ralph | A47B 13/16 108/42 |
| 2014/0261105 | A1 * | 9/2014 | Nafziger | A47B 9/20 108/97 |
| 2015/0068433 | A1 * | 3/2015 | Nardi | A47B 13/16 108/25 |
| 2015/0208634 | A1 | 7/2015 | Box et al. | |
| 2016/0242537 | A1 * | 8/2016 | Hernandez | A47B 9/08 |
| 2017/0042321 | A1 * | 2/2017 | Clause | A47B 37/04 |
| 2020/0163450 | A1 * | 5/2020 | Moore-Davis | A47B 3/10 |

* cited by examiner

PORTABLE MODULAR HEIGHT-ADJUSTABLE TABLE

CROSS-REFERENCE TO RELATED APPLICATION

This application claims the benefit of priority of U.S. provisional application No. 63/198,677, filed Nov. 3, 2020, the contents of which are herein incorporated by reference.

BACKGROUND OF THE INVENTION

The present invention relates to extendable tables, and more particularly, to a portable modular height-adjustable table with improved beverage protection.

Currently, no portable compact tabletops with sufficient space for beverages and snacks on multiple surfaces while sitting or standing exist. Some available products only provide space for one beverage and provide no space for snacks.

Some available products are limited to one surface, and may not be used on soft surfaces (such as, for example lawns or other soft ground), are not compact and may not be used in multiple small spaces and may not be portable, and are not height adjustable and do not provide improved beverage protection. Such tables are extremely limited as to where they may be used.

As can be seen, there is a need for a solution to one or more of the aforementioned problems.

SUMMARY OF THE INVENTION

In an exemplary embodiment, the present invention may provide a portable, height-adjustable, customizable and themed modular table system. In an exemplary embodiment of the present invention the table may comprise a height-adjustable table stem, a compact tabletop, and a multi-surface base.

In one embodiment the compact tabletop may comprise self-contained, movable beverage holders. The portable table may further comprise a removable compact, tabletop with self-contained, move-away cup holders which provide more space for snacks and beverages with improved beverage protection. The base member may comprise a plurality of features that permit it to support the tabletop on a variety of surfaces. The table stem may provide height adjustment for comfort while standing or sitting.

These and other features, aspects and advantages of the present invention will become better understood with reference to the following drawings, description, and claims.

BRIEF DESCRIPTION OF THE DRAWINGS

The following figures are included to illustrate certain aspects of the present disclosure and should not be viewed as exclusive embodiments. The subject matter disclosed is capable of considerable modifications, alterations, combinations, and equivalents in form and function, without departing from the scope of this disclosure.

DETAILED DESCRIPTION OF THE INVENTION

Figure 1:
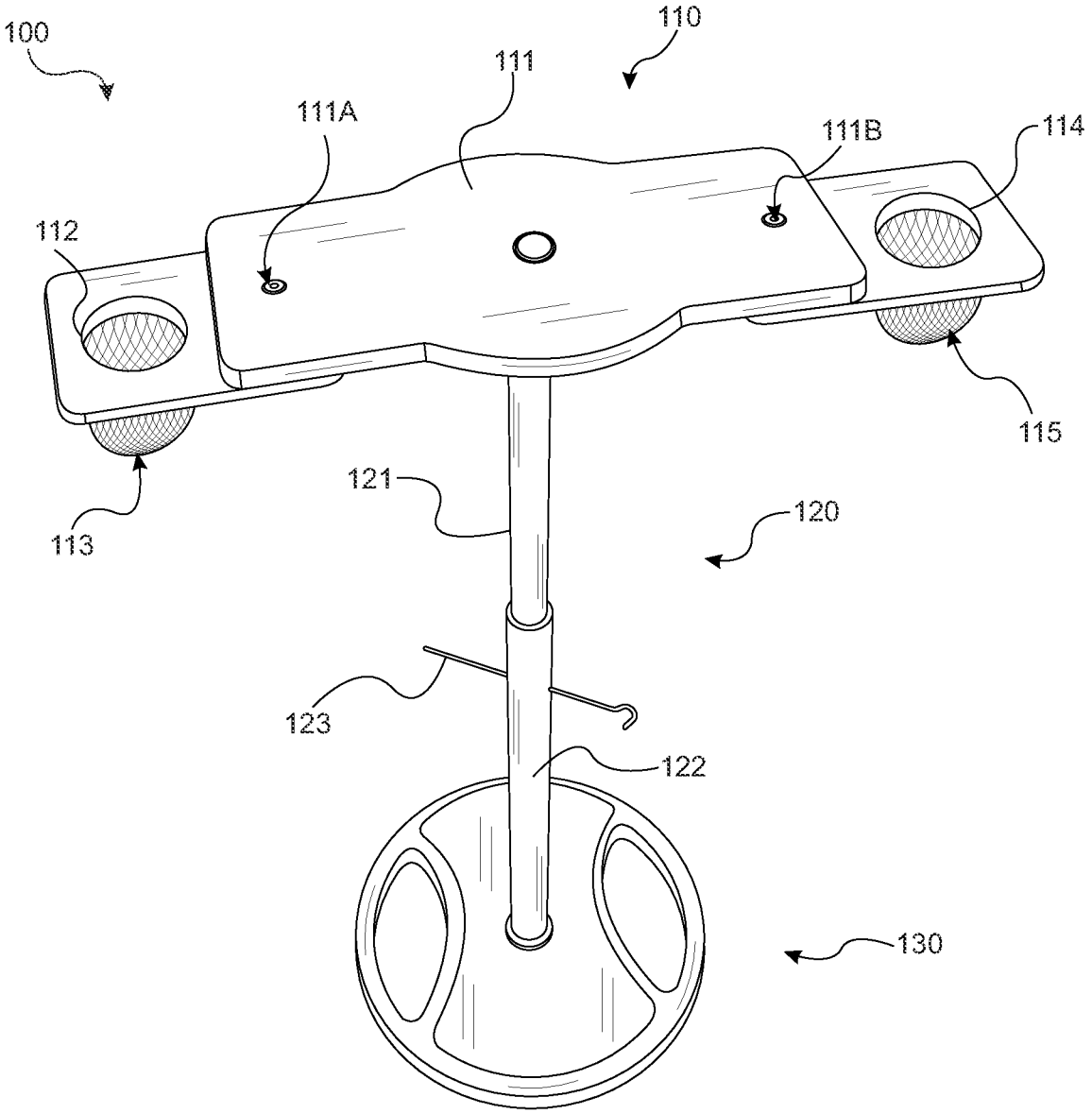
FIG. 1 is a perspective view of an embodiment of the present invention, shown in an assembled configuration and a deployed position.

The subject disclosure is described with reference to the drawings, wherein like reference numerals are used to refer to like elements throughout. In the following description, for purposes of explanation, numerous specific details are set forth in order to provide a thorough understanding of the present disclosure such that one skilled in the art will be enabled to make and use the present invention. It may be evident, however, that the present disclosure may be practiced without some of these specific details.

Broadly, an embodiment of the present invention provides a portable modular height-adjustable table, and table system for multiple surfaces with improved beverage protection.

In one aspect, the present invention may comprise a compact, height-adjustable tabletop with self-contained, sliding and/or rotating (also generalized herein to "moveable") beverage holders (that move in order to selectively stow or expose them) and a multi-surface base attachment. In another aspect, the present invention may provide a portable compact tabletop, with sufficient space for beverages and snacks, which may be used on multiple surfaces, while a user is sitting or standing. In yet another aspect, the present invention may provide a tabletop space for a plurality of beverage containers, and snacks. In a further aspect, the present invention may provide a compact height-adjustable tabletop usable on multiple surfaces.

In an exemplary embodiment, the present invention may comprise a portable, compact, self-contained, slide/rotate-away cup holder tabletop which provides more space for snacks and beverages, improved beverage protection, height adjustment for comfort while standing or sitting, and a multi-surface base attachment.

In an exemplary embodiment, the present invention may provide a compact portable table that comprises a telescoping height-adjustable base, and a tabletop constructed and arranged for secure detachable mounting on the base.

In some embodiments, the tabletop may further comprise self-contained sliding and/or rotating beverage holders (embodied as panels) constructed and arranged to provide sufficient space for beverages and snacks with improved beverage protection.

In some embodiments the table may comprise a multi-surface base attachment constructed and arranged to provide stability on different surfaces. The height adjustment system provided by the stem and/or pipes may provide convenient use while sitting or standing.

The table of the present invention distinguishes over, and provides a distinctive improvement over, any currently available tables. With self-contained moveable beverage holders, the tabletop options may provide a more compact and sufficient space for snacks and beverages. This invention may provide better protection to beverages, while offering a simpler height adjustment system with a more reliable multi-use base attachment allowing the product to be used on additional surfaces.

In an exemplary embodiment of the present invention, the stakable design of the multi-surface base attachment provides unsurpassed stability on soft surfaces. In an exemplary embodiment of the present invention, the suction cup base provides stability on many surfaces. In an exemplary embodiment, a multi-surface base may provide these functionalities in a single design.

In an exemplary embodiment, the table of the present invention may provide more space for snacks and beverages with improved beverage protection, height adjustment, and a more compact and portable product. The multi-surface base which may be used with the table of the present invention expands the utility of the table of the present invention and further distinguishes it from previous tables.

In an exemplary embodiment, the table of the present invention may be portable and comprise a compact, self-contained, move-away (via rotating and/or sliding) cup holder tabletop constructed and arranged to provide ample space for snacks and beverages with improved beverage protection. The table may further comprise a telescoping stand, constructed and arranged to provide height adjustment for comfort while a user is standing or sitting, and a multi-surface base attachment so that the table may be used on multiple types of surfaces.

Elements or portions of the table of the present invention may be used in other applications. For example, without limitation, the tabletops may be used as tabletops for end tables, or other tables for home or portable use, as tables in restaurants, and tables in sport/music venues. The slide-out beverage holders of the present invention may be installed on work shelving. A flip-down version of the table may be used in an automobile as a flip-down table or an airplane as a flip-down table.

In an exemplary embodiment of the present invention, the table of the present invention may comprise one or more of the following elements, or combinations thereof: a planar tabletop attachment with two planar beverage holder panels stored there beneath, the beverage holder panels constructed and arranged to be deployed laterally from a first storage position to a second deployed position for use; a planar tabletop attachment comprising two or more moveably mounted beverage holders attached thereto; a height-adjustable table stem or stand comprising first and second telescoping cylindrical members, the second telescoping cylindrical member having a greater length and larger diameter than the first telescoping cylindrical member, the first telescoping cylindrical member being constructed and arranged to be stored within the second telescoping member when the table stem has a first height, and to be upwardly extendable to provide a second taller table stem height, the table stem having a lower portion and an upper portion, the table stem being constructed and arranged to securely hold a tabletop at the upper portion thereof; and a plurality of interchangeable table base members, each constructed and arranged to receive and securely hold the lower portion of the table stem therein so that the table is supported by the multi-surface base member.

Referring now to FIGS. 1-9, the present invention may include a portable, modular height-adjustable table system. In an exemplary embodiment, a table system 100 of the present invention may comprise one or more of the following elements of components and combinations thereof. In particular, a table system 100 may include, in general, a tabletop 110, a table stem 120, and a base 130.

Figure 5:
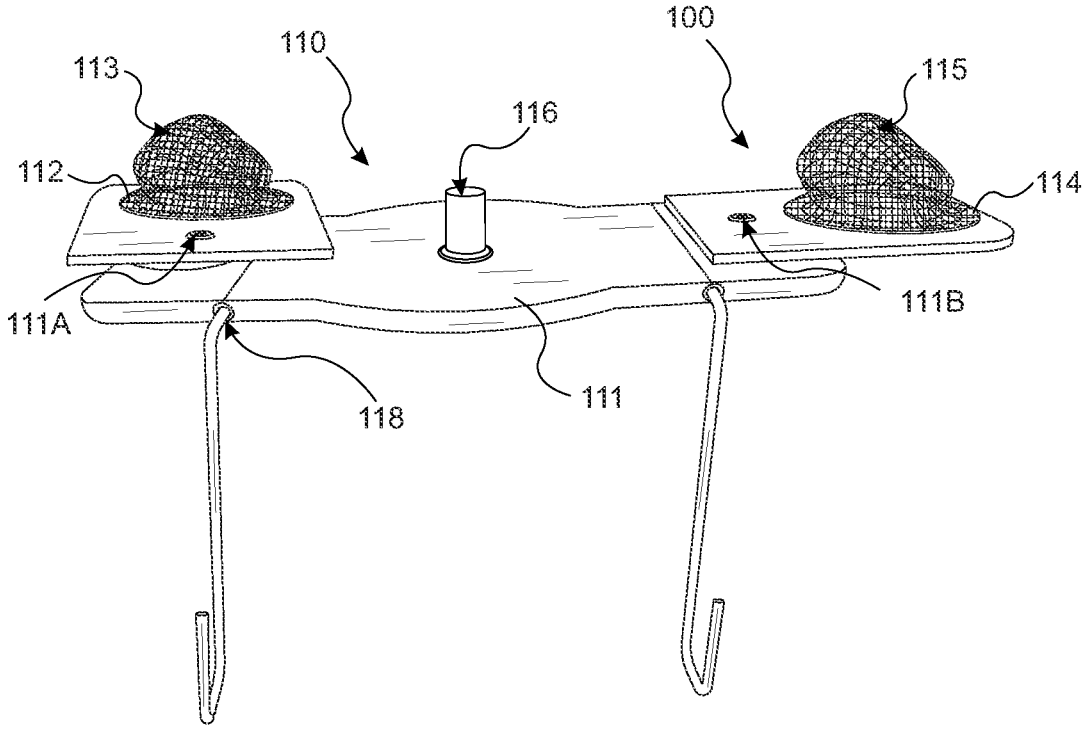
FIG. 5 is a detail bottom perspective view of the tabletop of the embodiment of the present invention.
Figure 6:
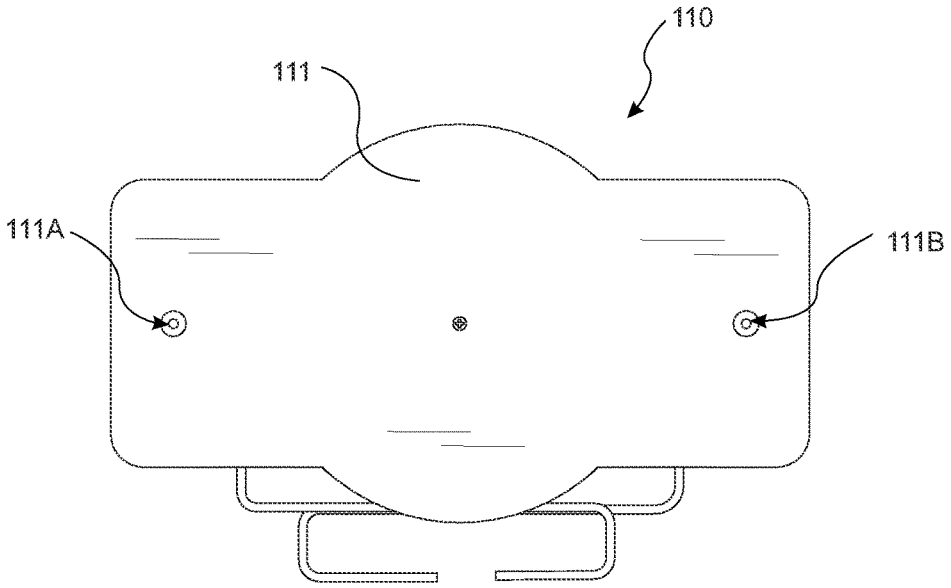
FIG. 6 is a detail top view of the tabletop of the embodiment of the present invention, shown in the storage position.
Figure 7:
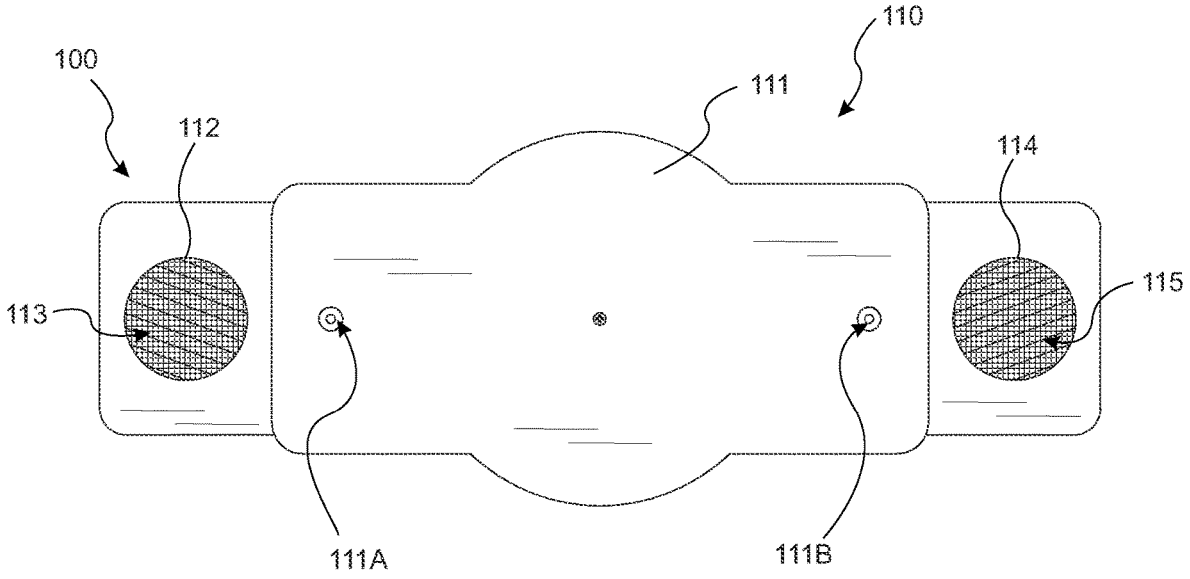
FIG. 7 is a detail top view of the tabletop of the embodiment of the present invention, shown in the deployed position.
Figure 8:
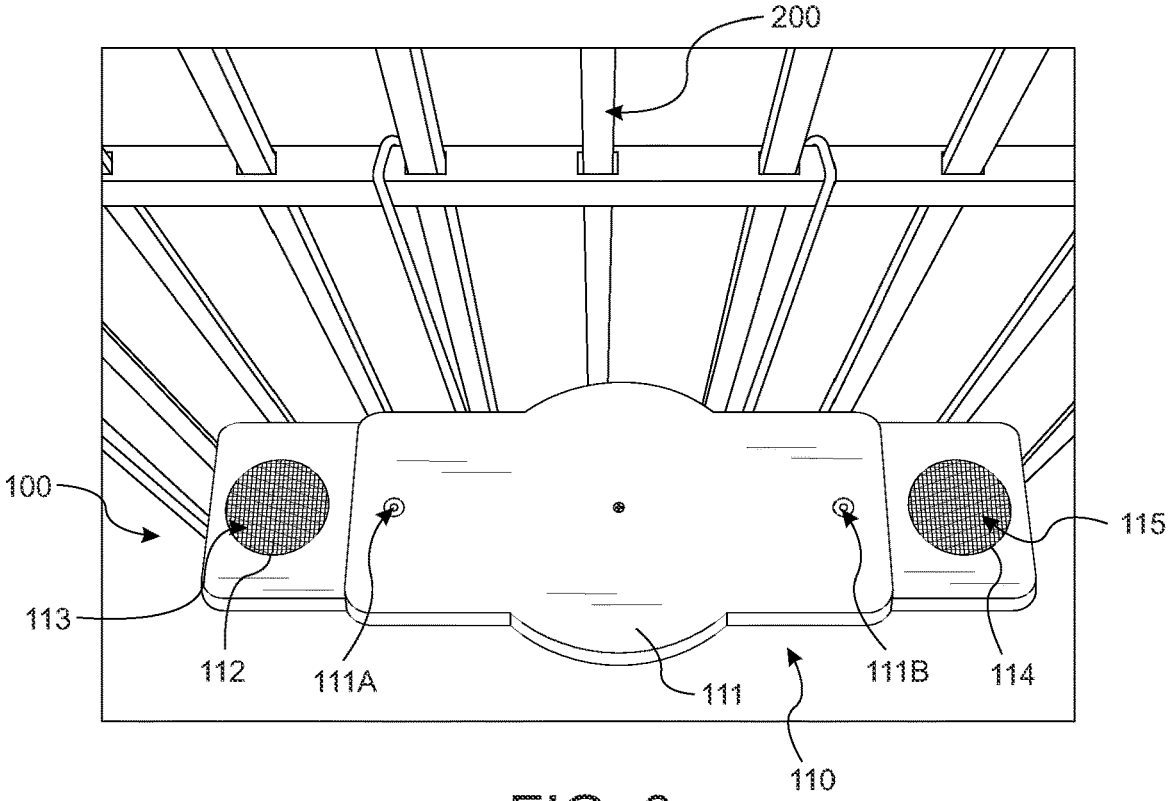
FIG. 8 is a perspective view of the tabletop of the embodiment of the present invention, shown in an alternative use position.

Making reference to FIG. 1, a tabletop 110 includes first plastic tabletop attachment 111 having two self-contained, move-away (such as by rotation or sliding) beverage holders 112, 114 (embodied as panels), which may be stored beneath the tabletop, and may be deployed by either rotating the beverage holders 112, 114 about respective pivot pins 111A, 111B or by sliding the beverage holders 112, 114 laterally. As shown in FIG. 1, the beverage holders 112, 114 include respective beverage holding portions 113, 115 for securely retaining a user's beverage. Advantageously, the holders 112, 114 can be rotated to a position underneath the tabletop attachment 111 to stow them away when not in use. FIG. 5 illustrates a tabletop coupling 116 coupled to or integral with a bottom surface of the tabletop attachment 111. Further, two holes 118 are defined on a rear side of the tabletop attachment 111 for receiving support rods 117. In use, the support rods 117 may be used to connect various structures, such as a fence 200. Accordingly, the tabletop 110 may be its own self-supporting structure, as needed. In addition, the support rods 117 may be used under the tabletop 110 with stem and base in use for hanging items for convenience.

The tabletop 110 may be any suitable size. For example, without limitation, the tabletop may comprise the following dimensions: Length: 18 inches (with the cup holders 112, 114 stored or slid in), and 27 inches (with the cup holders 112, 114 deployed or slid out); Width: 10 inches; and Height: ½ inch.

In other embodiments, there may further be provided a second plastic tabletop attachment having four self-contained slide-away or rotate-away beverage holders. The tabletop may be any suitable size. For example, without limitation, the tabletop may comprise the following dimensions: (Length: 14 inches (with the cup holders stored or slid in), 23 inches (with the cup holders deployed or slid out); Width: 14 inches: Height: ⅝ inches).

The tabletop 110 may be supported by a table stem 120 or stand formed from, for example, extruded pipes 121, 122. The upper pipe 122 may selectively couple with the projection 116 on the tabletop 111. One or more stem clips or connectors 123 are provided to maintain the table stem 120 at the desired height. In certain embodiments, the pipes 121, 122 may be, for example, but not limited to, 15½ inches long, with a diameter of 1¼ inch, or 25 inches long, with a diameter of 1¼ inch.

Figure 2:
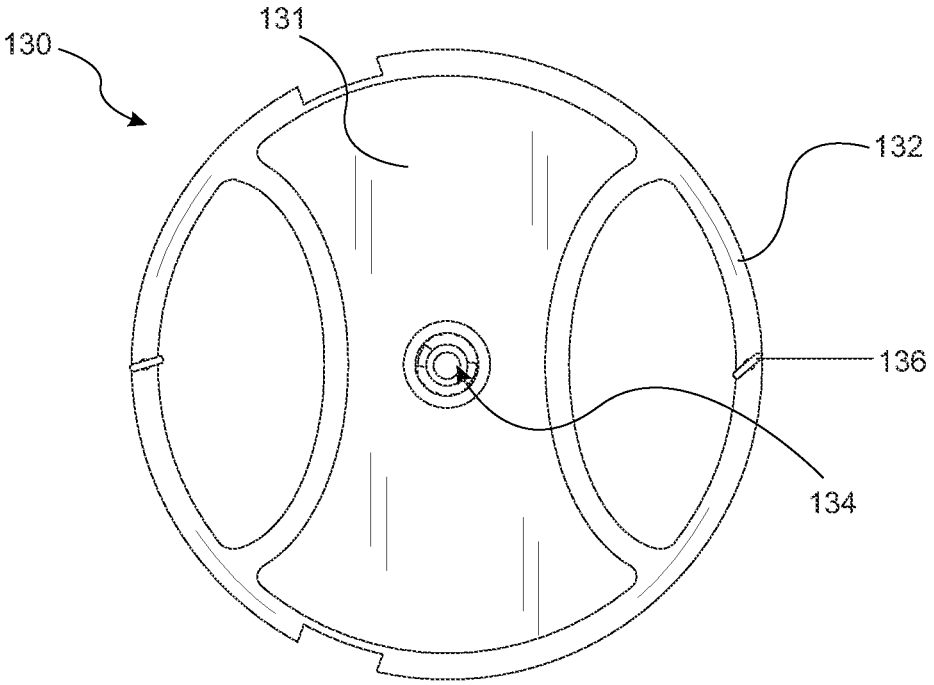
FIG. 2 is a detail top view of a multi-surface base of the embodiment of the present invention.
Figure 3:
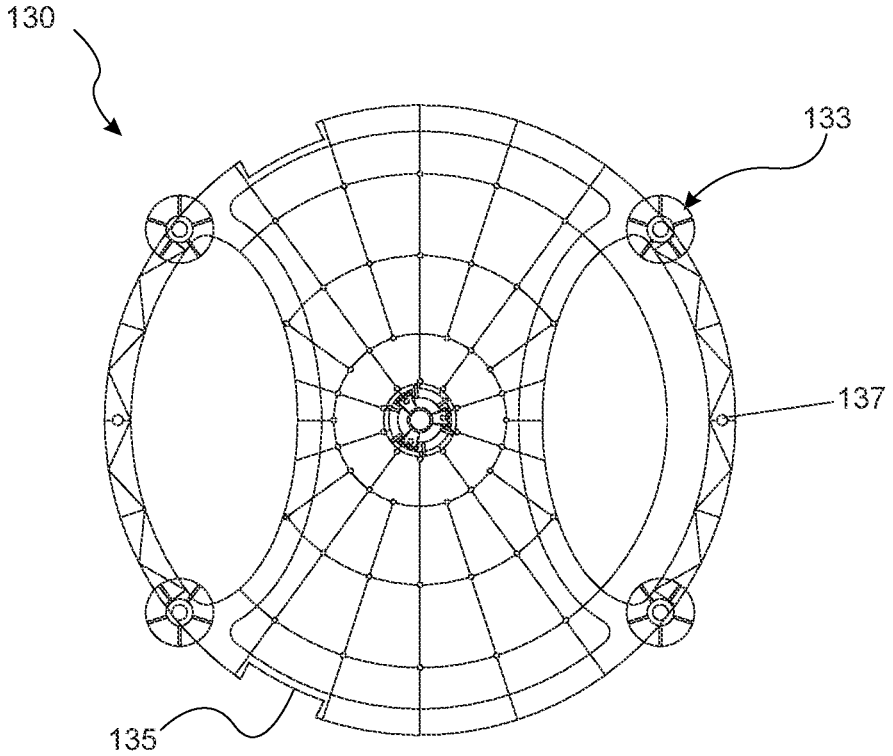
FIG. 3 is a detail bottom view of the multi-surface base of the embodiment of the present invention.
Figure 4:
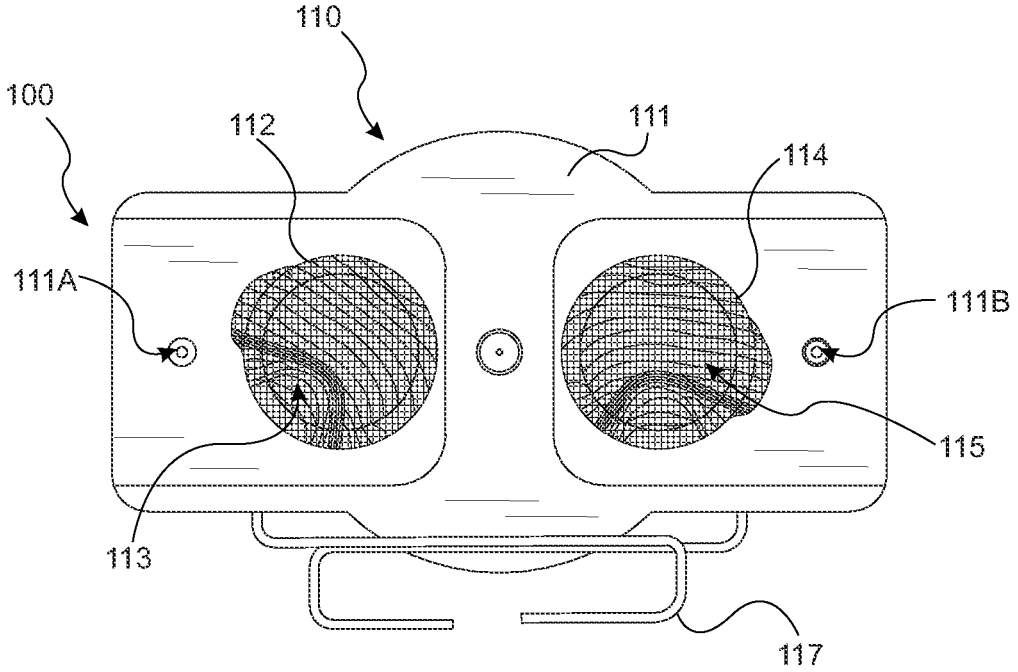
FIG. 4 is a detail bottom view of a tabletop of the embodiment of the present invention, shown in a storage position.
Figure 9:
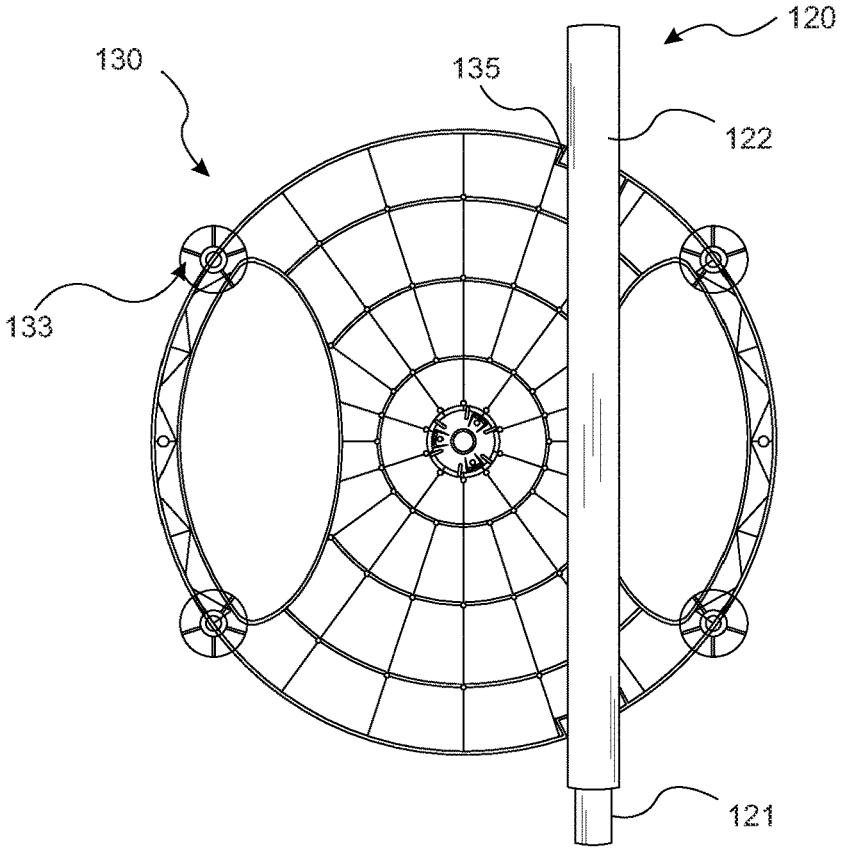
FIG. 9 is a detail bottom view of the multi-surface base of the embodiment of the present invention, shown with the table stems stored with the multi-surface base.

As shown in FIG. 1, a multi-surface base 130 may support the table stem 120, in use, via a base coupling 134. In certain embodiments, it may include a central portion 131 with a plurality of notches 135 (illustrated in FIGS. 3 and 9) defined therewithin, with the notches constituting end portions of a channel defined on a bottom side of the base 130. The channel may be used to retain the pipes 121, 122 of the table stem 120 when the assembly is collapsed, as illustrated in FIG. 9. Outer portions 132 of the base may include suction cups 133 for superior stabilization when resting on hard surfaces, such a pool or a flat concrete surface. As shown in FIG. 9, the outer portions 132 define a pair of side openings that enable the base 130 and collapsed stems 120 to be easily carried (with the outer portions 132 serving as handles to grasp). As shown in FIGS. 2-3, stake holes 137 are also formed the outer portions 132 for allowing stakes 136 to pass therethrough to secure the base 130 onto soft surfaces (such as a grass lawn), as needed. It will be appreciated that, while the notches 135, the stakes 136, and the stake holes 137 are not explicitly shown in FIG. 1, any base 130 (as represented in FIGS. 2, 3 and 9) in accordance with the present invention may incorporate these features for better supporting and/or transporting the rest of the assembly. Using a heavier material or other mechanisms to make the base 130 have more weight would improve stability.

In an exemplary embodiment, the elements or components may interrelate and be assembled as follows. The larger extruded pipe 122 attaches and fits into the base coupling 134 on top of the multi-surface base 130. The smaller extruded pipe 121 then fits into the larger extruded pipe 122. A butterfly clip on the smaller extruded pipe 121 snaps into different holes drilled in the larger extruded pipe 121 for height adjustment. It will be appreciated that other appropriate forms of connectors 123 may be used. The tabletop attachments 111 connect and attach via tabletop coupling 116, which fits on top of the smaller extruded pipe 121. A sticker packet may be chosen by the user and used to customize and theme the extruded piping 121, 122 and the base 130 to their liking.

In an exemplary embodiment, the present invention may be assembled and used in a process comprising one or more of the following steps. The multi-surface base 130 is assembled and connected to the largest extruded plastic pipe 122 to create a strong and sturdy foundation on any surface. The plastic base coupling 134 on top of the multi-surface base attachment is used to fit the largest plastic extruded pipe to the base securely. The extruded pipes 121 and 122 may have two or more pre-drilled holes at different points for height adjustment. The smaller plastic extruded pipe 121 fits into the larger pipe. The butterfly clip inside of the small pipe 121, moves and snaps into the pre-drilled holes of the larger pipe, allowing for height adjustment (as discussed above, other connectors 123 may be used and are in accordance with the present invention). The plastic tabletop attachment 111 has a tabletop coupling 116 on the bottom that can fit onto the top of the small pipe, securely fastening the tabletop 110. The self-contained, move-away cup holders 112, 114 protect the user's beverage and sufficient space for snacks on the tabletop. The sticker packets allow the user to make it their own by theming and customizing to their liking.

The present invention may be made by a process comprising one or more of the following steps. Select color of piping for the stem system 120. Assemble the embodiment, as described above. Attach the multi-surface base 130 to the bottom of the piping system 120. Then, attach the tabletop 110 (with self-contained, move-away cup holders 112, 114) to top of piping system 120. Then add selected themed sticker package to tabletop, stem and base for customization.

As discussed above, holes may be drilled in the tabletop attachment 111, a which may allow for support rods 117 to be slid inside to hook on fences 200 or sides of above-ground pools. The tabletop attachment 111, in other embodiments, may be reconfigured to float on water or be mounted as a shelf. A user of the table of the present invention may assemble the parts of the invention wherever needed. The assembly provides a compact, portable, and convenient way to have a user's food and beverage safely by their side.

In addition, many embodiments of the present invention have application to a wide range of industries. Additionally, the tabletop 110 may be beneficially used in furniture manufacturing. Tables and end tables at homes, bars, restaurants, and sport/music venues would be of great utility with the unique tabletop in accordance with the present invention. The auto and airplane industries could also benefit from the table design to be used in airplanes and cars. Further, work shelving could include the slide or rotate out beverage holders.

In summary, an exemplary embodiment of the present invention may provide a portable, modular height-adjustable table comprising a height-adjustable base member and a compact tabletop with self-contained, sliding beverage holders. The base member has a multi-surface base attachment. The portable table further comprises a removable compact tabletop with self-contained, slide-away cup holders which provide more space for snacks and beverages with improved beverage protection. The base member provides height adjustment for comfort while standing or sitting, and a multi-surface base attachment.

To the extent the present application discloses a system, the method implemented by that system is within the scope of the present invention. Further, to the extent the present application discloses a method, a system of apparatuses configured to implement the method are within the scope of the present invention.

What is claimed is:

1. A tabletop system comprising: a tabletop comprising: a substantially planar central tabletop attachment with a plurality of holes defined therein, each hole being configured to couple to a support rod or pivot, a first beverage holder panel and a second beverage holder panel oppositely disposed on the tabletop attachment and moveably coupled thereto; and a tabletop coupling provided on a bottom surface of the tabletop attachment; a table stem selectively couplable to the tabletop coupling; a base selectively couplable to the table stem; and a plurality of support rods or pivot pins, with each support rod or pivot pin being selectively couplable to a respective opening of the plurality of holes defined in the tabletop attachment; wherein the plurality of support rods are configured to support the tabletop by hooking onto an object or provide additional off-ground storage when used with the stem and base; wherein the base defines a channel on a bottom side thereof for retaining the table stem, when the table stem is uncoupled from the tabletop; and wherein the base further comprises a plurality of stake holes for receiving stakes therethrough.

2. The tabletop system of claim 1, wherein the first beverage holder panel and the second beverage holder panel are rotatable between: a deployed position wherein the beverage holder panels are exposed, and a storage position wherein the beverage holder panels nest against the bottom surface of the tabletop attachment.

3. The tabletop system of claim 1, wherein the table stem comprises a first telescoping member and a second telescoping member, with the first telescoping member nesting within the second telescoping member, and the table stem being vertically adjustable in height to modulate a height of the tabletop.

4. The tabletop system of claim 1, wherein the base further comprises a plurality of suction cups coupled to the bottom side of the base.

* * * * *